US011205566B2

(12) United States Patent
Jarrell et al.

(10) Patent No.: US 11,205,566 B2
(45) Date of Patent: Dec. 21, 2021

(54) APPARATUS AND METHOD FOR CONTACTLESS SAMPLING OF SOLUTIONS AND INTERFACE TO MASS SPECTROMETRY

(71) Applicant: Waters Technologies Corporation, Milford, MA (US)

(72) Inventors: Joseph A. Jarrell, Newton Highlands, MA (US); LeRoy B. Martin, Marblehead, MA (US)

(73) Assignee: Waters Technologies Corporation, Milford, MA (US)

( * ) Notice: Subject to any disclaimer, the term of this patent is extended or adjusted under 35 U.S.C. 154(b) by 0 days.

(21) Appl. No.: 16/913,186

(22) Filed: Jun. 26, 2020

(65) Prior Publication Data

US 2020/0411301 A1 Dec. 31, 2020

Related U.S. Application Data

(60) Provisional application No. 62/867,636, filed on Jun. 27, 2019.

(51) Int. Cl.

| | |
|---|---|
| ***H01J 49/00*** | (2006.01) |
| ***H01J 49/04*** | (2006.01) |
| ***H01J 49/16*** | (2006.01) |
| ***H01J 49/42*** | (2006.01) |

(52) U.S. Cl.
CPC ..... *H01J 49/0445* (2013.01); *H01J 49/165* (2013.01); *H01J 49/4215* (2013.01)

(58) Field of Classification Search
CPC ..... H01J 49/00; H01J 49/02; H01J 49/0445; H01J 49/165; H01J 49/4215; H01J 49/0431; B01L 2300/0858; B01L 2300/168; B01L 3/5085; B01L 3/5082
USPC ..... 250/281, 282, 288
See application file for complete search history.

(56) References Cited

U.S. PATENT DOCUMENTS

| | | | | |
|---|---|---|---|---|
| 2002/0109084 | A1 | 8/2002 | Ellson et al. | |
| 2005/0142033 | A1 | 6/2005 | Glezer et al. | |
| 2009/0209151 | A1* | 8/2009 | Suzuki | B63H 21/213 440/86 |
| 2009/0290151 | A1 | 11/2009 | Agrawal et al. | |
| 2014/0319335 | A1 | 10/2014 | Morris et al. | |
| 2016/0086758 | A1* | 3/2016 | Iwasaki | H01J 27/026 250/281 |

(Continued)

OTHER PUBLICATIONS

International Search Report and Written Opinion for International application No. PCT/US2020/039788, dated Oct. 22, 2020, 18 pages.

(Continued)

*Primary Examiner* — Jason L McCormack
(74) *Attorney, Agent, or Firm* — Kacvinsky Daisak Bluni PLLC

(57) ABSTRACT

A method of mass spectrometry is disclosed comprising focusing electromagnetic radiation into a region of a liquid sample 3 below a surface of the liquid sample so as to generate one or more bubbles 4. The one or more bubbles 4 rise to the surface of the liquid whereupon one or more droplets of liquid 6 are emitted from the surface of the liquid sample. The method further comprises directing the one or more emitted droplets 6 towards an inlet of a mass spectrometer 8.

14 Claims, 3 Drawing Sheets

(56) References Cited

U.S. PATENT DOCUMENTS

| | | | | |
|---|---|---|---|---|
| 2017/0117125 | A1 | 4/2017 | Brown | |
| 2019/0122878 | A1 * | 4/2019 | Holman | H01J 49/0004 |

OTHER PUBLICATIONS

Cremers, D.A., et al., Spectrochemical Analysis of Liquids Using the Laser Spark, Applied Spectroscopy 38(5):721-729 (1984).
Xiu, J., et al., Quantitative Analysis of Trace Metals in Engine Oil Using Indirect Ablation-Laser Induced Breakdown Spectroscopy, Journal of Applied Spectroscopy 86(1):43-49 (2019).

* cited by examiner

APPARATUS AND METHOD FOR CONTACTLESS SAMPLING OF SOLUTIONS AND INTERFACE TO MASS SPECTROMETRY

CROSS-REFERENCE TO RELATED APPLICATION

This application claims priority from and the benefit of U.S. Provisional Patent Application No. 62/867,636 filed on Jun. 27, 2019, the entire content of which is incorporated herein by reference.

FIELD OF THE INVENTION

The present invention relates generally to mass spectrometry, mass spectrometers and in particular to methods of ejecting droplets from a sample liquid. The present invention also relates to a sample well and a microtitre plate comprising a plurality of sample wells.

BACKGROUND

It is known to utilise acoustic droplet ejection from liquid samples in 96 well microtitre plates. This process can be used for contactless dispensing of aliquots of reference compounds in drug discovery. It can also be used to provide contactless sampling and ionisation of library compounds for mass spectral analysis.

However, a disadvantage of known acoustic droplet ejection methods is that an acoustic transducer must be mechanically coupled either with a solid member or through use of a coupling fluid to the sample well containing the sample to be dispensed or analysed. It will be appreciated that this requirement of needing to mechanically couple the acoustic transducer to the sample well can limit sampling speed.

The known approach also suffers from the problem of being relatively inflexible since the acoustic transducer and the associated coupling means must reside underneath the sample container.

Furthermore, acoustic ejection is problematic in the context of frequent non-destructive sampling. For example, it is known to grow cells and organoids in the sample wells of microtitre plates and it is often desired to perform regular or repeated non-destructive sampling of excreted or consumed products. It will be understood by those skilled in the art that conventional acoustic sampling methods are not suitable for frequent non-destructive sampling applications especially of cells and organoids.

It is therefore desired to provide an improved method of contactless sampling of solutions and subsequent mass spectral analysis of such solutions. In particular, it is desired to be able to perform frequent non-destructive sampling of sample liquid from sample wells containing cells or organoids.

SUMMARY

According to an aspect there is provided a method of mass spectrometry comprising:

focusing electromagnetic radiation into a region of a liquid sample below a surface of the liquid sample so as to generate one or more bubbles which rise to the surface of the liquid whereupon one or more droplets of liquid are emitted from the surface of the liquid sample; and directing the one or more emitted droplets towards an inlet of a mass spectrometer or an ion source.

According to various embodiments focused electromagnetic radiation or focused optical radiation may be used to create or generate one or more bubbles below the surface of a liquid to be sampled. The optical radiation may comprise near infrared radiation and may have a wavelength in the range 750-1500 nm.

The one or more bubbles which are created in the liquid sample to be analysed rise up to the surface of the liquid sample whereupon the one or more bubbles burst. The bursting of the one of more bubbles at the surface causes surface perturbation effects which cause one or more droplets of the liquid to be ejected from the surface of the liquid.

The method may be used to interface ejected droplets to a mass spectrometer for subsequent mass spectral analysis of the liquid sample.

According to various embodiments the method of optically induced droplet ejection may be used in combination with Field Induced Droplet Ionisation ("FIDI") to ionise the ejected droplets.

According to various other embodiments ejected droplets may be interfaced to a mass spectrometer and associated Electrospray ion source via an open port sampling interface.

Droplets which have been ejected from the liquid sample may also be suspended in an electrodynamic or acoustic trap prior to being ionised by a Field Induced Droplet Ionisation ("FIDI") ion source or other ion source for enhanced ion production.

The various embodiments are particularly suitable for sampling of cell cultures and organoids in microtitre plates. Cell cultures and organoids may be sampled using low energy input laser induced droplet ejection allowing for repeated non-destructive sampling which is not possible with known acoustic droplet sampling approaches.

The liquid sample may be provided in a sample well of a microtitre plate or multi-well sample plate.

The approach of contactless sampling using a focused laser source according to various embodiments is particularly suited for sampling from microtitre plates or multi-well sample plates. In contrast to known acoustic sampling methods which require mechanical coupling of the acoustic transducer to the sample well, according to the disclosed contactless sampling method using a focused laser source according to various embodiments does not require mechanical coupling and hence the focused laser source method can be operated at higher speeds with a microtitre plate or multi-well sample plate than conventional acoustic sampling methods.

The step of focusing electromagnetic radiation may comprise directing electromagnetic radiation either: (i) through a base or lower portion of the microtitre plate or multi-well sample plate; (ii) through a sidewall or side portion of the microtitre plate or multi-well sample plate; or (iii) from above an upper surface of the liquid.

The approach of contactless sampling using a focused laser source according to various embodiments is more flexible than conventional acoustic sampling methods. Whereas with acoustic sampling the ultrasonic waves are only directed through the bottom of a microtitre plate, according to various embodiments the focused electromagnetic radiation may be focused through a sidewall of the microtitre plate or the focused electromagnetic radiation may be directed onto the liquid sample from above. The ability to focus electromagnetic radiation, for example, from above the liquid sample enables the same focusing optics which are used to focus a laser beam into the liquid sample to be used in conjunction with a second source or electromagnetic radiation or a second laser source to determine the height or depth of the liquid sample in the sample well.

The step of focusing electromagnetic radiation may comprise directing the electromagnetic radiation through one or more focusing lenses.

The use of one or more focusing lenses (which may be customised) enables the electromagnetic radiation to be focused into a liquid sample with a high degree of precision and accuracy. Various aspects of the laser beam can be readily adapted or altered in a manner which is not possible with acoustic sampling. For example, the beam profile can be optimised for droplet generation and visible electromagnetic radiation can be used in order to image the focusing effects.

The method may further comprise moving or translating the one or more focusing lenses in order to focus or auto-focus the electromagnetic radiation to a desired depth below an upper surface of the liquid sample.

The ability to auto-focus the electromagnetic radiation to a consistent desired depth below the upper surface of the liquid sample wherein the volume or depth of liquid may change significantly from sample well to sample well in a multi-well or microtitre plate format represents a significant advance in the art in the field of contactless sampling. Conventional acoustic sampling methods may assume that sample wells of a multi-well sample plate are all filled to the same level. However, liquid samples created at different points in time, from different sources or following different methodologies may be combined into separate sample wells of a multi-well sample plate. As a result, the depth of liquid in sample wells of a multi-well sample plate may change significantly from sample well to sample well. The method of contactless sampling using an electromagnetic radiation source or laser according to the various embodiments in conjunction with auto-focusing of the electromagnetic radiation enables the system to process at high speed multi-well sample plates having sample wells comprising different amounts of liquid samples. Furthermore, the system according to various embodiments is particularly suited to the sampling of liquid from sample wells comprising cells or organoids wherein as the cells or organoids grow or develop with time then liquid may be excreted and/or consumed and the volume of liquid in the sample well may change, increase or decrease with time.

The method may further comprise passing a second source of electromagnetic or laser radiation through the one or more focusing lenses in order to determine the location of the upper surface of the liquid sample.

The method according to various embodiments enables the sample optics which are used to focus a primary laser source into the liquid sample for droplet ejection to also be used to focus a secondary laser source on to the liquid sample in order to determine the location of the upper surface of the liquid sample. As a result, the focal point of the primary laser source can be adjusted so that the primary laser source is focused to a desired or optimal depth below the upper surface of the liquid sample.

The method may further comprise reflecting the electromagnetic radiation using a mirror having one or more apertures.

The method according to various embodiments enables various compact optical arrangements to be utilised. According to an embodiment droplets which are emitted from a liquid sample can be arranged to be transmitted through a mirror which was used to focus laser radiation into the liquid sample in order to cause droplet ejection.

The method may further comprise causing or allowing the one or more emitted droplets to pass through the one or more apertures.

The apertures, openings or holes which may be provided in the mirror can be made to be small enough so as to just accommodate emitted droplets passing therethrough. The one or more apertures may also help to ensure that droplets which are emitted from the surface of the liquid sample are correctly aligned with a subsequent ionisation stage. For example, if a droplet were to be ejected from the surface of the liquid sample at an undesired angle then the droplet may impinge upon the mirror and be prevented from continuing to the subsequent ionisation stage.

The electromagnetic radiation may comprise laser radiation.

It is not essential that the electromagnetic radiation comprises laser radiation. For example, embodiments are contemplated wherein the electromagnetic radiation may comprise light from an incoherent light source such as an incandescent bulb. However, laser radiation from a laser source can be manipulated relatively easily and in particular various parameter of the laser radiation which is directed into the liquid sample such as the beam cross-sectional profile, intensity and wavelength can be set or otherwise optimised for optimum droplet generation. It is contemplated, for example, that different cross-sectional profiles and/or intensities and/or wavelengths can be utilised with different samples or may be used in different sampling protocols.

The electromagnetic radiation may comprise one or more pulses of electromagnetic radiation.

It is not essential that the electromagnetic radiation is pulsed. For example, embodiments are contemplated wherein a continuous source of electromagnetic or laser radiation may be utilised. Embodiments are contemplated, for example, wherein the intensity of the laser radiation which is directed into a liquid sample may be varied between two or more different levels. One level may be above an intensity threshold which is sufficient to cause droplet ejection and the other second level may be below an intensity threshold which is required in order to cause droplet ejection.

The electromagnetic radiation may have a wavelength in the wavelength range 750-1500 nm.

Various embodiments which are of particular interest may utilise an electromagnetic or laser radiation source wherein the electromagnetic or laser radiation is in the near infra-red. The visible wavelength range of light may be considered to be in the range 380-740 nm. Accordingly, electromagnetic radiation in the range 750-1500 nm may be considered to be in the near infra-red. Laser radiation in the range 750-1500 nm may be particularly suitable for causing droplet ejection from certain liquids wherein the liquid sample has a relatively high absorption at such wavelengths. Embodiments are contemplated wherein the electromagnetic radiation or laser radiation has a wavelength in the range 750-800 nm, 800-850 nm, 850-900 nm, 900-950 nm, 950-1000 nm, 1000-1050 nm, 1050-1100 nm, 1100-1150 nm, 1150-1200 nm, 1200-1250 nm, 1250-1300 nm, 1300-1350 nm, 1350-1400 nm, 1400-1450 nm or 1450-1500 nm. Other embodiments are contemplated wherein the laser radiation may have a wavelength >1500 nm and may, for example, be in the mid infra-red or far infra-red wavelength range. The laser radiation may also be in the range 300-350 nm, 350-400 nm, 400-450 nm, 450-500 nm, 500-550 nm, 550-600 nm, 600-650 nm, 650-700 nm or 700-750 nm. For example, the laser radiation may be in visible wavelength range of 380-740 nm or may be in the ultra-violet wavelength range which is approximately 10-400 nm. In particular, the laser radiation may be in the UVA wavelength range of 315-400 nm.

The step of directing the one or more emitted droplets towards an inlet of a mass spectrometer may comprise causing the one or more emitted droplets to pass through an electric field defined by two or more electrodes.

According to various embodiments the one or more droplets which are emitted from a liquid sample may be ionised by a number of different techniques. According to an embodiment the one or more droplets may be ionised by Field Induced Droplet Ionisation ("FIDI") wherein the droplets pass through an electric field caused by the application of one or more voltages to at least one electrode of a pair of electrodes. The electrodes may comprise a pair of flat plate electrodes or alternatively the electrodes may be shaped.

The electric field may be arranged to cause the one or more emitted droplets to elongate and emit oppositely charged jets towards the electrodes.

The method of Field Induced Droplet Ionisation ("FIDI") may be utilised according to various embodiments in order to ionise the droplets emitted from the liquid sample whereupon the resulting analyte ions or charged particles are then directed into an inlet of a mass spectrometer for subsequent analysis.

The method may further comprise directing at least one jet through at least one aperture in at least one of the electrodes towards an inlet of the mass spectrometer.

According to various embodiments the approach of Field Induced Droplet Ionisation ("FIDI") may cause droplets present between the two electrodes to become elongated and to form jets which are directed towards one or both electrodes. The jets include analyte ions which may be transmitted through one or more apertures, openings or holes in the electrodes so that the analyte ions are then onwardly transmitted towards an inlet of a mass spectrometer or another analytical instrument such as an ion mobility spectrometer.

The step of directing the one or more emitted droplets towards an inlet of a mass spectrometer may comprise directing the one or more emitted droplets into an open port probe sampling interface.

It is not essential that droplets are ionised by Field Induced Droplet Ionisation ("FIDI"). For example, other embodiments are contemplated wherein the emitted droplets may be sampled by an open port probe sampling interface comprising two coaxial tubes. Captured droplets may be diluted into a continuous flow of solvent provided by a low pressure pump. The fluid stream may then be aspirated into an electrospray ionisation ion source whereupon the sample is ionised by electrospray ionisation.

The method may further comprise capturing the one or more emitted droplets and diluting the one or more emitted droplets into a continuous flow of solvent.

Sampling the emitted droplets with an open port probe sampling interface may involve mixing the droplets with a flow of solvent provided by a low pressure pump. Sample delivery may be decoupled from ionisation and a continuous flow of solvent may help to mitigate carryover effects.

The method may further comprise aspirating the flow into an electrospray ionisation ion source.

Sampling the emitted droplets with an open port probe sampling interface may involve ionising the droplets and solvent mixture using an electrospray or other type of ion source which may be arranged for rapid ionisation. Accordingly, embodiments are contemplated wherein droplets emitted from a liquid sample may be ionised in a rapid manner enabling a high throughput mass spectrometry system to be provided.

The method may further comprise optionally directing the one or more emitted droplets through the inlet of the mass spectrometer and causing the one or more emitted droplets to become ionised upon impacting an impact ionisation surface.

Embodiments are contemplated wherein the emitted droplets are ionised using an ionisation technique such as impact ionisation. Embodiments are contemplated wherein a voltage such as 1 kV may be applied to the impact ionisation surface. The one or more droplets may be arranged to impact upon the impact ionisation surface with a velocity of e.g. ≥50 m/s, ≥60 m/s, ≥70 m/s, ≥80 m/s, ≥90 m/s or ≥100 m/s.

The method may further comprise increasing or varying the intensity or pulse energy of electromagnetic radiation focused into the region of the liquid sample until one or more bubbles are observed or detected and/or analyte ions are detected.

Various embodiments are contemplated wherein the amplitude, intensity or pulse width of the electromagnetic radiation which is focused into the liquid sample may be varied or optimised. For example, it may be desired to generate or sample droplets from a liquid sample in a manner which causes minimal disturbance to the sample. In order to cause minimal disturbance to the sample which may comprise, for example, cells or an organoid which is sensitive to external stimuli or influence, the intensity of the electromagnetic or laser radiation which is pulsed into the liquid sample may be set below a threshold at which bubbles are formed. The amplitude, intensity or pulse width may then be progressively increased or otherwise varied until the amplitude, intensity or pulse width exceeds a threshold at which point one or more bubbles may be observed or detected. The bubbles may be directly observed with an imaging system or camera. Alternatively, the generation of bubbles may be indirectly detected by detecting the presence of analyte ions at the mass spectrometer.

According to another aspect of the present invention there is provided a sampling system for a mass spectrometer comprising:

one or more focusing lenses for focusing electromagnetic radiation into a region of a liquid sample below a surface of the liquid sample so that, in use, one or more bubbles are generated which rise to the surface of the liquid causing one or more droplets of liquid to be emitted from the surface of the liquid sample; and an ionisation device for ionising the one or more emitted droplets of liquid.

According to various embodiments focused electromagnetic radiation or focused optical radiation is used to create or generate one or more bubbles below the surface of a liquid to be sampled. The optical radiation may comprise near infrared radiation and may have a wavelength in the range 750-1500 nm.

The one or more bubbles which are created in the liquid sample to be analysed rise up to the surface of the liquid sample whereupon the one or more bubbles burst. The bursting of the one of more bubbles at the surface causes surface perturbation effects which cause one or more droplets of the liquid to be ejected from the surface of the liquid.

The method may be used to interface ejected droplets to an ion source and a mass spectrometer for subsequent mass spectral analysis of the liquid sample.

The ionisation device may comprise two or more electrodes and wherein the one or more emitted droplets may be caused to pass through an electric field defined by the two or more electrodes.

According to various embodiments optically induced droplet ejection may be used in combination with Field Induced Droplet Ionisation ("FIDI") to ionise the ejected droplets.

According to various other embodiments ejected droplets may be interfaced to a mass spectrometer and associated ion source via an open port sampling interface.

Droplets which have been ejected from the liquid sample may also be suspended in an electrodynamic or acoustic trap prior to being ionised by a Field Induced Droplet Ionisation ("FIDI") ion source or other ion source for enhanced ion production.

The various embodiments are particularly suitable for sampling of cell cultures and organoids in microtitre plates. Cell cultures and organoids may be sampled using low energy input laser induced droplet ejection allowing for repeated non-destructive sampling which is not possible with known acoustic droplet sampling approaches.

Alternatively, the ionisation device may comprise an impact ionisation surface.

Embodiments are contemplated wherein the emitted droplets are ionised by impact ionisation. Embodiments are contemplated wherein a voltage such as 1 kV may be applied to the impact ionisation surface. The one or more droplets may be arranged to impact upon the impact ionisation surface with a velocity of e.g. ≥50 m/s, ≥60 m/s, ≥70 m/s, ≥80 m/s, ≥90 m/s or ≥100 m/s.

According to another aspect there is provided a mass spectrometer comprising a sampling system as disclosed above.

The mass spectrometer according to various embodiments is particularly suitable for the analysis of cells and/or organoids which may be growing in a sample well of a sample plate.

According to another aspect there is provided a sample well comprising one or more lip or step portions having a metallic coating.

According to various embodiments one or more sample wells may be provided. The one or more sample wells may form a multi-well sample plate or a microtitre sample plate. One or more lip or step portions may be provided having a metal or metallic coating. According to various embodiments the electromagnetic or laser radiation may be directed on to the metal or metallic coating. The sample well is particularly suited for repeated sampling in a non-destructive manner of fluids surrounding cells or organoids which may be present in the sample well. According to various embodiments the electromagnetic or laser radiation is not directed into the main body of the sample well but is instead directed onto a side lip or step portion. As the fluid level in the sample well may vary, according to various embodiments a number of different lip or step portions may be provided so that at least one lip or step portion is a desired depth below the upper surface of the liquid sample.

Each lip or step portion may comprise an annular region surrounding an upper region of the sample well and wherein, in use, laser radiation is focused on to or above one or more of the lip or step portions and below a surface of a liquid sample so as to generate one or more bubbles which rise to the surface of the liquid whereupon one or more droplets of liquid are emitted from the surface of the liquid sample.

According to various embodiments laser radiation may be directed away from the main sample well so as to avoid any risk of impinging directly upon a sample in the sample well. Instead, the laser radiation may be targeted on to a lip or step portion which may have a metallic coating. Assuming that a plurality of lip or step portions are provided at different heights above the top of the sample well then at least one lip or step portion should be at an optimal height below the surface of the liquid sample.

According to another aspect there is provided a microtitre plate or multi-well sample plate comprising a plurality of sample wells as described above.

A microtitre plate may be provided having multiple sample wells wherein each sample well has a plurality of annular lip or step regions surrounding the opening to the sample well and from which liquid in the sample well may be sampled by causing one or more droplets of liquid to be ejected.

The mass spectrometer may comprise one or more continuous or pulsed ion sources.

The mass spectrometer may comprise one or more ion guides.

The mass spectrometer may comprise one or more ion mobility separation devices and/or one or more Field Asymmetric Ion Mobility Spectrometer devices.

The mass spectrometer may comprise one or more ion traps or one or more ion trapping regions.

The mass spectrometer may comprise one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device.

The ion-molecule reaction device may be configured to perform ozonolysis for the location of olefinic (double) bonds in lipids.

The mass spectrometer may comprise a mass analyser selected from the group consisting of: (i) a quadrupole mass analyser; (ii) a 2D or linear quadrupole mass analyser; (iii)

a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic mass analyser arranged to generate an electrostatic field having a quadro-logarithmic potential distribution; (x) a Fourier Transform electrostatic mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser.

The mass spectrometer may comprise one or more energy analysers or electrostatic energy analysers.

The mass spectrometer may comprise one or more ion detectors.

The mass spectrometer may comprise one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wien filter.

The mass spectrometer may comprise a device or ion gate for pulsing ions; and/or a device for converting a substantially continuous ion beam into a pulsed ion beam.

The spectrometer may comprise a C-trap and a mass analyser comprising an outer barrel-like electrode and a coaxial inner spindle-like electrode that form an electrostatic field with a quadro-logarithmic potential distribution, wherein in a first mode of operation ions are transmitted to the C-trap and are then injected into the mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the mass analyser.

The mass spectrometer may comprise a stacked ring ion guide comprising a plurality of electrodes each having an aperture through which ions are transmitted in use. The apertures in the electrodes in an upstream section of the ion guide may have a first diameter and the apertures in the electrodes in a downstream section of the ion guide may have a second diameter which is smaller than the first diameter. Opposite phases of an AC or RF voltage may be applied, in use, to successive electrodes.

The mass spectrometer may comprise a device arranged and adapted to supply an AC or RF voltage to the electrodes. The AC or RF voltage optionally has an amplitude selected from the group consisting of: (i)<50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; and (xi) >500 V peak to peak.

The AC or RF voltage may have a frequency selected from the group consisting of: (i)<100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

The ion guide may be maintained at a pressure selected from the group consisting of: (i) <0.0001 mbar; (ii) 0.0001-0.001 mbar; (iii) 0.001-0.01 mbar; (iv) 0.01-0.1 mbar; (v) 0.1-1 mbar; (vi) 1-10 mbar; (vii) 10-100 mbar; (viii) 100-1000 mbar; and (ix) >1000 mbar.

Analyte ions may be subjected to Electron Transfer Dissociation ("ETD") fragmentation in an Electron Transfer Dissociation fragmentation device. Analyte ions may be caused to interact with ETD reagent ions within an ion guide or fragmentation device.

Optionally, in order to effect Electron Transfer Dissociation either: (a) analyte ions are fragmented or are induced to dissociate and form product or fragment ions upon interacting with reagent ions; and/or (b) electrons are transferred from one or more reagent anions or negatively charged ions to one or more multiply charged analyte cations or positively charged ions whereupon at least some of the multiply charged analyte cations or positively charged ions are induced to dissociate and form product or fragment ions; and/or (c) analyte ions are fragmented or are induced to dissociate and form product or fragment ions upon interacting with neutral reagent gas molecules or atoms or a non-ionic reagent gas; and/or (d) electrons are transferred from one or more neutral, non-ionic or uncharged basic gases or vapours to one or more multiply charged analyte cations or positively charged ions whereupon at least some of the multiply charged analyte cations or positively charged ions are induced to dissociate and form product or fragment ions; and/or (e) electrons are transferred from one or more neutral, non-ionic or uncharged superbase reagent gases or vapours to one or more multiply charged analyte cations or positively charged ions whereupon at least some of the multiply charge analyte cations or positively charged ions are induced to dissociate and form product or fragment ions; and/or (f) electrons are transferred from one or more neutral, non-ionic or uncharged alkali metal gases or vapours to one or more multiply charged analyte cations or positively charged ions whereupon at least some of the multiply charged analyte cations or positively charged ions are induced to dissociate and form product or fragment ions; and/or (g) electrons are transferred from one or more neutral, non-ionic or uncharged gases, vapours or atoms to one or more multiply charged analyte cations or positively charged ions whereupon at least some of the multiply charged analyte cations or positively charged ions are induced to dissociate and form product or fragment ions, wherein the one or more neutral, non-ionic or uncharged gases, vapours or atoms are selected from the group consisting of: (i) sodium vapour or atoms; (ii) lithium vapour or atoms; (iii) potassium vapour or atoms; (iv) rubidium vapour or atoms; (v) caesium vapour or atoms; (vi) francium vapour or atoms; (vii) $C_{60}$ vapour or atoms; and (viii) magnesium vapour or atoms.

The multiply charged analyte cations or positively charged ions may comprise peptides, polypeptides, proteins or biomolecules.

Optionally, in order to effect Electron Transfer Dissociation: (a) the reagent anions or negatively charged ions are derived from a polyaromatic hydrocarbon or a substituted polyaromatic hydrocarbon; and/or (b) the reagent anions or negatively charged ions are derived from the group consisting of: (i) anthracene; (ii) 9,10 diphenyl-anthracene; (iii) naphthalene; (iv) fluorine; (v) phenanthrene; (vi) pyrene; (vii) fluoranthene; (viii) chrysene; (ix) triphenylene; (x) perylene; (xi) acridine; (xii) 2,2' dipyridyl; (xiii) 2,2' biquinoline; (xiv) 9-anthracenecarbonitrile; (xv) dibenzothiophene; (xvi) 1,10'-phenanthroline; (xvii) 9' anthracenecarbonitrile; and (xviii) anthraquinone; and/or (c) the reagent ions or negatively charged ions comprise azobenzene anions or azobenzene radical anions.

The process of Electron Transfer Dissociation fragmentation may comprise interacting analyte ions with reagent ions, wherein the reagent ions comprise dicyanobenzene, 4-nitrotoluene or azulene.

The mass spectrometer may be operated in various modes of operation including a mass spectrometry ("MS") mode of operation; a tandem mass spectrometry ("MS/MS") mode of operation; a mode of operation in which parent or precursor ions are alternatively fragmented or reacted so as to produce fragment or product ions, and not fragmented or reacted or fragmented or reacted to a lesser degree; a Multiple Reaction Monitoring ("MRM") mode of operation; a Data Dependent Analysis ("DDA") mode of operation; a Data Independent Analysis ("DIA") mode of operation; a Quantification mode of operation; or an Ion Mobility Spectrometry ("IMS") mode of operation.

The electrodes may comprise electrodes which are formed on a printed circuit board, printed wiring board or an etched wiring board. For example, according to various embodiments the electrodes may comprise a plurality of traces applied or laminated onto a non-conductive substrate. The electrodes may be provided as a plurality of copper or metallic electrodes arranged on a substrate. The electrodes may be screen printed, photoengraved, etched or milled onto a printed circuit board or equivalent. According to an embodiment the electrodes may comprise electrodes arranged on a paper substrate impregnated with phenolic resin or a plurality of electrodes arranged on a fibreglass mat impregnated within an epoxy resin. More generally, the electrodes may comprise one or more electrodes arranged on a non-conducting substrate, an insulating substrate or a plastic substrate. According to embodiments the plurality of electrodes may be arranged on a substrate.

A plurality of insulator layers may be interspersed or interleaved between an array of electrodes. The plurality of electrodes may be arranged on or deposited on one or more insulator layers.

BRIEF DESCRIPTION OF THE DRAWINGS

Various embodiments will now be described, by way of example only, and with reference to the accompanying drawings in which.

DETAILED DESCRIPTION

Various embodiments will now be described in further detail.

Figure 1:
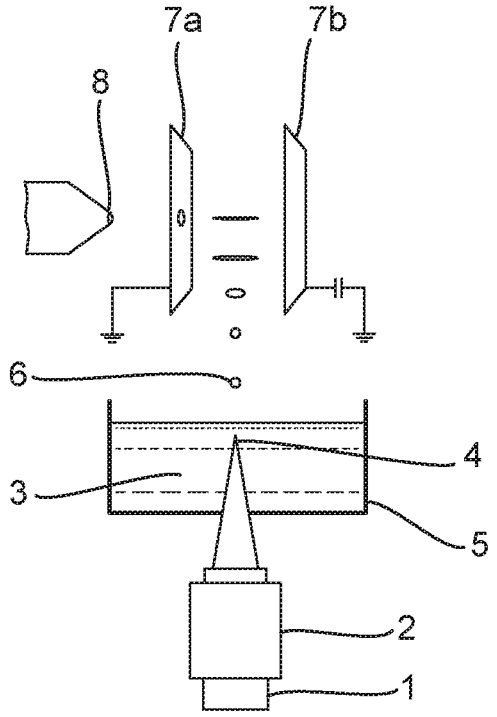
FIG. 1 shows an embodiment wherein a laser is focused from underneath a liquid sample causing or inducing droplet ejection whereupon the ejected droplets are ionised by Field Induced Droplet Ionisation ("FIDI") and the resulting ions are then mass analysed by a mass spectrometer for detection of dissolved analytes.

FIG. 1 shows an embodiment wherein a laser beam 1 is focused by a microscope objective 2 which is positioned underneath a liquid solution 3 to be sampled and analysed. The liquid solution 3 may be provided in a liquid container 5 such as a sample well of a multi-well sample plate such as a microtitre plate.

A pulsed laser beam 1 of suitable wavelength is focused using the microscope objective 2 (or other optical device) to a location just below the surface of the liquid solution or liquid sample 3. Selecting an appropriate location and laser pulse energy, one or more bubbles 4 of solvent vapor may be formed or otherwise generated just below the liquid surface. For example, one or more bubbles may initially be created <1 mm, 1-2 mm, 2-3 mm, 3-4 mm or >4 mm below the surface of the liquid sample 3. According to an embodiment the laser energy may be focused to a depth of 0.5 mm below the surface of the liquid sample 3. As one or more bubbles are created or otherwise generated, the one or more bubbles rise upwards to the surface of the liquid sample 3 and cause one or more liquid droplets 6 to be ejected from the liquid surface. The one or more liquid droplets 6 may be ejected from the liquid surface in a vertical direction.

As will be described in more detail with reference to FIG. 2, the focusing microscope objective 2 (or other optical device) and the laser beam 1 may be located in different positions or orientations to that shown in FIG. 1. For example, according to an embodiment the focusing microscope objective 2 (or other optical means) may be located above the liquid sample 3. If the microscope objective 2 (or other optical means) is located above the liquid sample 3 then the electromagnetic radiation or laser radiation is focused below the surface of the liquid sample 3 so that one or more bubbles are generated just below the surface of the liquid sample 3.

According to other embodiments the laser beam 1 may be focused through the sidewall of the liquid container 5. The liquid container 5 may be made of a transparent material and may have a general construction which is arranged and adapted to adequately transmit the laser beam 1 or other electromagnetic radiation.

Referring again to FIG. 1, the one or more ejected droplets 6 may be caused to rise in a vertical direction through a pair of parallel plate electrodes 7*a*,7*b*. The electrodes may be spaced 1.4 mm apart for example or may be spaced 0.5-1.0, 1.0-1.5, 1.5-2.0, 2.0-2.5, 2.5-3.0, 3.0-3.5, 3.5-4.0, 4.0-4.5, 4.5-5.0 or >5.0 mm apart. The one or more droplets 6 may pass through an electric field defined by the two parallel plate electrodes 7*a*,7*b*. A first electrode 7*a* as shown on the left-hand side of FIG. 1 may be held or maintained at ground or zero volts while the other second electrode 7*b* on the right-hand side of FIG. 1 may be held at a relatively high voltage such as <500 V, 500-1000V, 1.0-1.5 kV, 1.5-2.0 kV, 2.0-2.5 kV, 2.5-3.0 kV, 3.0-3.5 kV, 3.5-4.0 kV or >4 kV. The pair of electrodes 7*a*,7*b* may be arranged to generate an electric field that causes the one or more droplets 6 to elongate in a horizontal direction and symmetrically emit two oppositely charged jets from either end towards both electrodes 7*a*,7*b*. The jet as shown on the left-hand side of FIG. 1 may be arranged to pass or be directed through one or more apertures, openings or holes which may be provided in the first electrode 7*a*. The ions thus formed may then be sampled via an inlet 8 of a mass spectrometer. Ions within the mass spectrometer may pass through a plurality of ion optical devices before being mass analysed by a mass analyser.

The embodiment shown in FIG. 1 depicts only one polarity of ions being detected, but according to other embodiments ions of the opposite polarity may be simultaneously detected via a second inlet to the mass spectrometer. According to such an embodiment, ions may be transmitted through one or more apertures, openings or holes provided in the second electrode 7*b* and are then directed to a second inlet of the mass spectrometer.

Alternatively, the polarity of the high voltage applied to the second electrode 7*b* can be reversed in order to achieve the same effect. Reversing the polarity of the second electrode 7*b* may be synchronized with droplet formation. Alternatively, the reversal of polarity may be performed sufficiently rapidly such that each individual droplet 6 can be analyzed for each polarity.

According to various embodiments one or more individual droplets 6 may be trapped in an atmospheric pressure acoustic trap (not shown) such that a sustained droplet or ion stream may then be extracted. The one or more droplets may also be trapped or otherwise retained in an atmospheric pressure electrodynamic trap if the one or more droplets are charged.

It will be understood by those skilled in the art that there are a variety of other ways of extracting ions from droplets. Such approaches may also be used in conjunction with the method of laser induced droplet ejection according to various embodiments.

It is not necessary to utilise a coherent light source to cause droplet ejection. Other embodiments are also contemplated wherein one or more incoherent light sources may be used to cause droplet ejection from the liquid sample.

Figure 2:
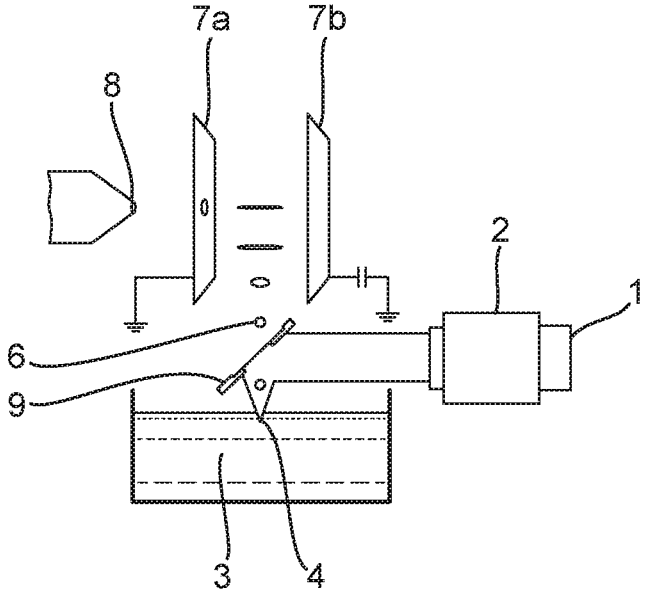
FIG. 2 shows another embodiment wherein the laser is focused from above the liquid sample causing or inducing droplet ejection whereupon the ejected droplets are ionised by Field Induced Droplet Ionisation ("FIDI") and the resulting ions are then mass analysed by a mass spectrometer for detection of dissolved analytes.

FIG. 2 shows another embodiment wherein the laser source 1 is arranged above the liquid sample 3. According to this embodiment, laser induced droplet ejection is arranged from above the liquid sample 3 and may be coupled with Field Induced Droplet Ionisation ("FIDI") for mass spectrometry detection of dissolved analyte.

According to this embodiment a mirror 9 may be provided which may have one or more apertures, openings or holes provided therein. The mirror 9 may be arranged to reflect the laser beam 1 down onto the liquid sample 3 and in particular to ensure that the focal point of the laser beam 1 is just below the upper surface of the liquid sample 3.

The one or more apertures, openings or holes which may be provided in the mirror 9 may be arranged so as to allow one or more droplets 6 which are emitted from the surface of the liquid sample 3 to pass therethrough. The one or more droplets 6 which pass through the one or more apertures, openings or holes provided in the mirror 9 may then be ionised. The portion of the laser beam 1 which is not reflected by the mirror 9 but which passes through the one or more apertures, openings or holes provided in the mirror 9 is omitted for clarity purposes. According to various embodiments the mirror 9 may be planar, curved or parabolic.

One or more droplets 6 which pass through the one or more apertures, openings or holes provided in the mirror 9 may then be arranged to pass through an electric field defined by two parallel plate electrodes 7*a*,7*b* in a similar manner to the embodiment described above with reference to FIG. 1. A first electrode 7*a* as shown on the left-hand side of FIG. 2 may be held at ground or zero potential while a second electrode 7*b* as shown on the right-hand side of FIG. 2 may be held at high voltage or potential such as <500 V, 500-1000V, 1.0-1.5 kV, 1.5-2.0 kV, 2.0-2.5 kV, 2.5-3.0 kV, 3.0-3.5 kV, 3.5-4.0 kV or >4 kV.

One or more droplets 6 which are ejected from the liquid sample 3 and which pass between the two electrodes 7*a*,7*b* may be caused to elongate in a generally horizontal direction. As a result, two oppositely charged jets may be symmetrically ejected towards the first and second electrodes 7*a*,7*b*. The jet directed at or towards the first electrode on the left-hand side of FIG. 2 may be arranged to pass through one or more apertures, opening or holes provided in the first electrode 7*a*. The ions may then be sampled by a mass spectrometer ("MS"). Ions may pass through an inlet 8 to the mass spectrometer and may then pass through a plurality of ion optical devices before being mass analysed by a mass analyser.

Automation of Laser Focus Position and/or Laser Pulse Power

For many applications multiple samples (or compound libraries) to be dispensed and/or analysed may be contained in, for example, 96 well microtitre plates or other multi-well sample plate format.

The different samples present in different sample wells of a multi-well sample plate may comprise different liquids which may have different physical properties. Furthermore, the liquid levels in each individual well may differ from one another.

According to various embodiments parameters such as laser power and the position of the laser focus may be adjusted for individual wells allowing rapid automated analysis of such multiple samples to be achieved.

According to various embodiments the laser power and focus may be optimized automatically under microprocessor control.

For example, it may be desirable to position the laser focus about 500 μm below the surface of the liquid sample 3. This can be achieved by utilising an optical system which automatically focuses a laser beam 1 either on the liquid surface or just below the liquid surface.

Various different methods of auto-focusing a camera or a microscope are known which may be adapted in order to auto-focus the laser beam 1 so that the laser beam 1 focuses just below the surface of the liquid sample. Reference is made to two commercial products namely a Continuous Reflection Interface Sampling and Positioning ("CRISP") system by Applied Scientific Instrumentation®, Eugene, Oreg. and a Laser Autofocus System by Prior Scientific®, Rockland Mass. as examples of auto-focusing systems which may be utilised according to various embodiments.

Figure 3:
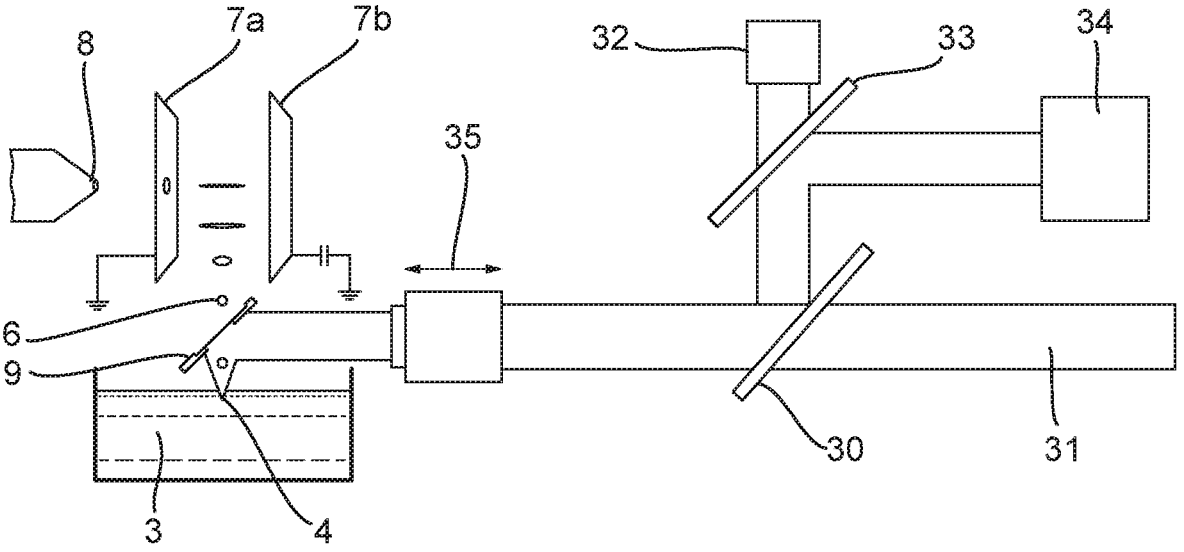
FIG. 3 shows another embodiment wherein the laser is focused from above the liquid sample causing or inducing droplet ejection and wherein a second laser is used to determine the surface of the liquid sample whereupon the position of a focusing lens may be adjusted in order to focus the laser to a desired depth below the surface of the liquid sample and whereupon the ejected droplets are ionised by Field Induced Droplet Ionisation ("FIDI") and the resulting ions are mass analysed by a mass spectrometer for detection of dissolved analytes.

FIG. 3 illustrates in more detail an embodiment wherein the laser beam is auto-focused into the liquid sample. As shown in FIG. 3, a dichroic beam splitter 30 may be placed or provided in the path of a primary laser beam 31. A second laser source 32 may be provided which may be arranged to emit a secondary laser beam. The second laser source 32 may comprise a red laser diode source 32 which may be arranged to emit a laser beam that is reflected by the dichroic beam splitter 30 such that the secondary laser beam is aligned with the primary laser beam 31. The red laser diode source 32 may emit the secondary laser beam with a wavelength of 690 nm.

The primary laser beam 31 is focused by a movable microscope objective 35 and the primary laser beam 31 is reflected by a mirror 9 towards the surface of the liquid sample 3. The mirror 9 may be provided with one or more apertures, opening or holes provided therein. The one or more apertures, openings or holes may be arranged so as to allow one or more droplets 6 which are emitted from the surface of the liquid sample 3 to pass therethrough. The portion of the primary laser beam 31 which is not reflected by the mirror 9 but which passes through the one or more apertures, openings or holes is omitted for clarity purposes. The mirror 9 may be planar, curved or parabolic.

The red laser light emitted from the secondary laser source 32 may be reflected by the upper liquid surface of the liquid sample. The reflected red laser light may be arranged to be imaged by the microscope objective 35 (and any necessary auxiliary optics, not shown) onto the imaging sensor of an electronic camera 34. The red reflected light is reflected by the dichroic beam splitter 30 which is arranged to reflect red light but transmit most other wavelengths. The red light is also reflected by a further beam splitter 33 on to the camera 34 or other detector. The image produced by or on the camera 34 or other detector may be analysed by software in a computer (not shown). The software may be arranged to produce a signal that will cause an actuator to move or translate the microscope objective 35 so that it focuses the red laser beam on to the liquid surface (or to a position such the red laser beam is focused just above the liquid surface or just below the liquid surface). Accordingly, the focal point of the primary laser beam 31 can also be adjusted to a desired or optimum depth.

Alternatively, the location of the liquid surface relative to the microscope objective 35 may be determined by optical or ultrasonic range finding techniques and the position of the laser focus may be adjusted accordingly.

Ultrasonic range finding is used, for example, with a Polaroid® SX-70 camera and such a method may be used according to various embodiments.

Laser range finding techniques are also used for autofocusing in some smartphone cameras and in some surveying applications and such techniques may be used according to various embodiments in order to determine the desired or optimum focal point for the primary laser source 31.

Since the primary laser beam 31 entering the rear of the focusing objective 35 is essentially parallel, then the focal point of the primary laser beam 31 will always be at a known fixed distance with respect to the mechanical front of the objective 35. Thus, it suffices to measure the distance of the objective 35 from the liquid surface.

Once the surface of the liquid sample 3 is located or otherwise determined, the laser focus may then be automatically moved, adjusted or set to an appropriate distance below the surface of the liquid sample 3.

Once the laser focus has been automatically moved, positioned, adjusted or otherwise set, the laser pulse energy may also be adjusted or otherwise optimised. For example, the laser pulse energy may be directly controlled by an electrical signal. According to various embodiments the pulse energy may be increased incrementally starting from a sub-threshold energy level until bubble and/or jet formation is observed by the camera 34. These events may be identified by image analysis software running in real-time in the associated computer.

According to various embodiments, an auxiliary lens may be inserted in between the dichroic beam splitter 30 and the camera 34 so that reflected red laser light can be imaged by the camera 34 at different levels at and above the surface of the liquid without disturbing the focal point of the primary laser beam 31. In the case of mass spectrometric detection, the appearance of an output signal from the mass spectrometer may be utilised to indicate that an appropriate pulse energy level has been reached.

Impact Ionisation Ion Source

Figure 4:
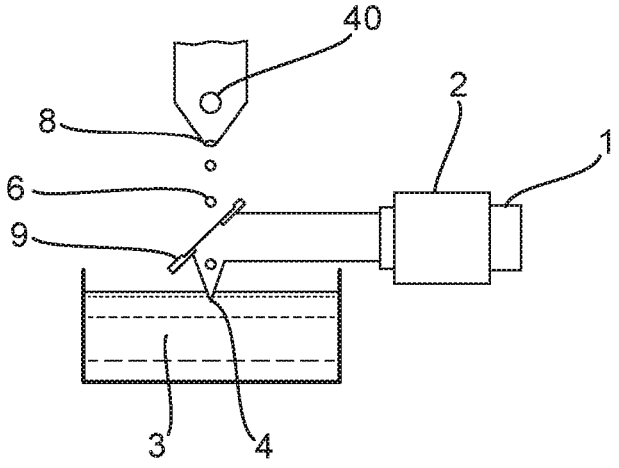
FIG. 4 shows another embodiment wherein the laser is focused from above the liquid sample causing or inducing droplet ejection whereupon the ejected droplets are ionised by an impact ionisation ion source and the resulting ions are then mass analysed by a mass spectrometer for detection of dissolved analytes.

FIG. 4 shows a further embodiment wherein laser induced droplet ejection is performed from above the liquid sample 3 but the ejected droplets 6 are ionised by an impact ionisation ion source 40.

A laser beam 1 is focused by a microscope objective 2 and is reflected towards the surface of the liquid sample 3 by a mirror 9.

The mirror 9 may be provided which may have one or more apertures, openings or holes provided therein. The mirror 9 may be arranged to reflect the laser beam 1 down onto the liquid sample 3 and in particular to ensure that the focal point of the laser beam 1 is below the upper surface of the liquid sample 3. The one or more apertures, openings or holes are arranged so as to allow one or more droplets 6 which are emitted from the surface of the liquid sample 3 to pass therethrough. The portion of the laser beam which is not reflected by the mirror 9 but which passes through the one or more apertures or holes is omitted for clarity purposes. The mirror 9 may be planar, curved or parabolic.

A co-aligned beam of low power optical radiation (not shown) may be used to locate the liquid surface. An acoustic signal may alternatively be used to locate the liquid surface.

The one or more droplets 6 which pass through the one or more apertures, openings or holes provided in the mirror 9 may then be ionized by an impact ionization ion source 40. The portion of the laser beam 1 which is not reflected by the mirror 9 but which passes through the one or more apertures, openings or holes provided in the mirror 9 is omitted for clarity purposes. According to various embodiments the mirror 9 may be planar, curved or parabolic.

One or more droplets 6 which pass through the one or more apertures, openings or holes provided in the mirror 9 may be arranged to pass through an inlet 8 of a mass spectrometer and may be directed by gas flow effects to impact upon an impact ionisation surface 40. The impact ionisation surface 40 may comprise an impact ionisation pin or impactor pin 40 which may be held at a relatively high voltage such as 1 kV. Droplets which impact upon the impact ionisation pin or impactor pin 40 may become ionised. The impact ionisation method is used to ionise droplets by an impact ionisation ion source for mass spectrometry detection of dissolved analytes.

Microtitre Plate

Figure 5:
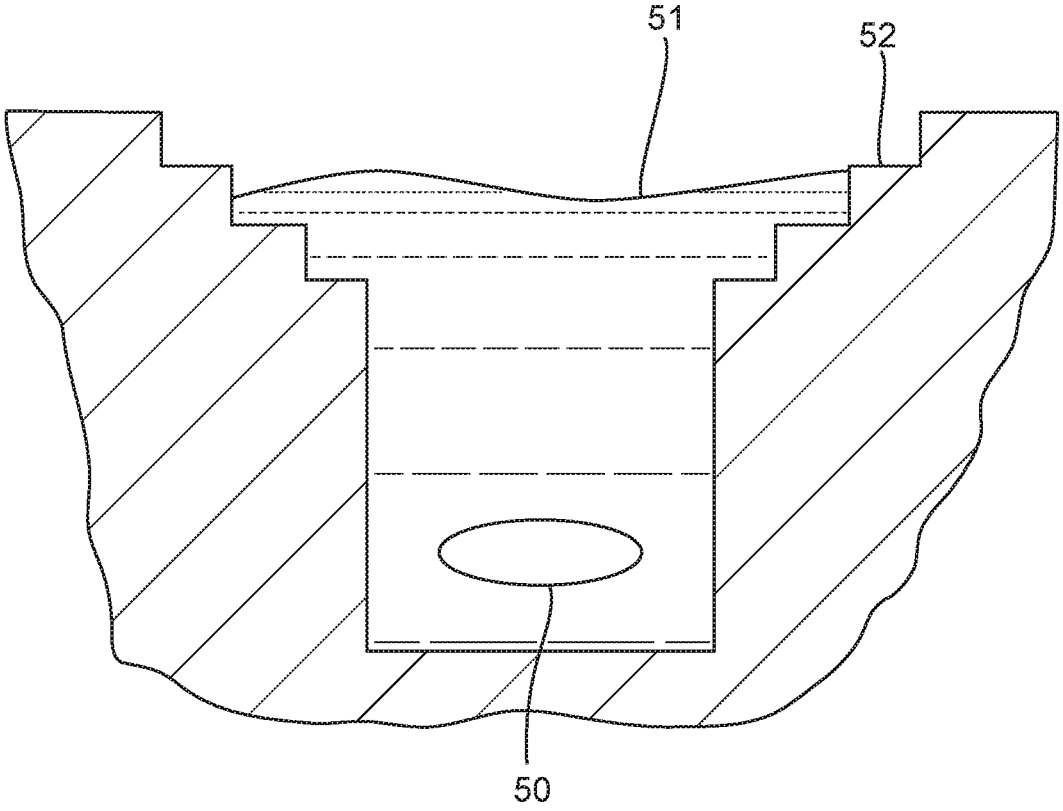
FIG. 5 shows a microtitre plate sample well for use in combination with a nitrogen laser or other laser source according to various embodiments and which is particularly suitable for frequent non-destructive sampling of cells or organoids.

FIG. 5 shows a microtitre plate well having a plurality of lips or steps for use with a nitrogen laser or other laser according to various embodiments.

Cells or organoids 50 may be disposed in one or more sample wells of the microtitre plate. The cells or organoids 50 may be suspended in a broth or liquid which provides nutrients to the cells or organoids 50. The cells or organoids 50 may also excrete metabolites and other substances and liquids which contribute to the liquid level in the sample well. The upper liquid level 51 of a sample in a sample well is indicated in FIG. 5. According to various embodiments, the sample well may comprise one or more lips, stepped portions or annular surfaces which surround the upper portion of the sample well. In the particular example shown in FIG. 5, three lips, stepped portions or annular surfaces are shown although it should be understood that according to various embodiments 1, 2, 3, 4, 5, 6, 7, 8, 9, 10 or more than 10 lips, stepped portions or annular surfaces may be provided. The upper surface of one or more of the lips, stepped portions or annular surfaces may be coated with a metal or metallic film 52. The metal or metallic film 52 may be deposited on one or more lips, step portions or annular surfaces which may be provided on edge layers of the microtitre plate well.

The one or more lips, step portions or annular surfaces may be used to eliminate any risk of directly irradiating cells or organoids 50 which may be located within the sample well. According to various embodiments a laser source is focused onto or just above the metal or metallic film 52 layer rather than being directed into the main body of the sample well thereby ensuring that the laser radiation does not impinge upon any cells or organoids 50 present in the sample well. Instead, it is assured that the laser radiation only impinges upon the liquid or broth provided in the sample well and/or any liquid excreted by the cells or organoids 50.

The use of a metal or metallic surface, film or layer 52 allows use of optical wavelength lasers such as nitrogen lasers. In particular, water and various solvents do not have significant absorbance at such optical wavelengths. According to an embodiment a nitrogen laser may be used which may be arranged to emit in the ultra-violet wavelength region of the electromagnetic spectrum with a wavelength of, for example, 337.1 nm. It will be understood that nitrogen lasers and other lasers operating in the visible or near ultra-violet wavelengths are relatively inexpensive and are often less expensive than comparable infrared lasers. Furthermore, lasers such as nitrogen lasers and other lasers operating in the visible or near ultra-violet can utilise less complex and less expensive focusing and steering optics which are also relatively robust. For example, glass or fused silica optics may be used which are relatively inexpensive.

It should also be understood that whilst metallic surfaces are often thought of as being primarily reflectors, such surfaces also have a significantly higher absorbance at visible or near ultra-violet wavelengths compared to water or other liquids which may be provided in the sample well. As a result, the provision of a metalised area or surface around one or more lips of the sample well enables droplet ejection to be effective with or from these layers 52. It is assumed that the liquid in the sample well is subjected to sufficient mixing and/or diffusion such that sample liquid which is sampled from the one or more lips, step portions or annular surfaces by focusing electromagnetic radiation onto a region of the lip, step portion or annular surface 52 and below the upper surface 51 of the liquid is indicative or representative of the broth or liquid surrounding the cells or organoids 50 and includes any metabolites, chemicals, substances or liquids which may have been excreted by the cells or organoids 50.

It will be understood that according to various embodiments focusing the laser radiation on to the one or more lips, step portions or annular surface rather than into the main body of the sample well avoids any of the optical radiation impinging upon the cells or organoids 50 within the sample well. It will be understood that focusing optical radiation onto the cells or organoids 50 or focusing optical radiation to a region in close proximity to the cells or organoids 50 may have a deleterious or negative impact upon the cells or organoids 50 particularly if liquid from the sample well is repeatedly sampled from the sample well.

Although embodiments are contemplated wherein just one lip, step portion or annular surface is provided around or surrounding an upper portion of the sample well, according to other embodiments a plurality of lips, step portions or annular surfaces are provided since the provision of multiple lips, step portions or annular surfaces eliminates, reduces or avoids any need to fill the liquid level in the sample well precisely or to maintain a certain amount of liquid within the sample well. In particular, sample liquid initially provided in the sample well may be consumed by the cells or organoids 50 over a period of time so that the upper level of the liquid 51 may change or become lower with time. Accordingly, if multiple lips, step portions or annular surfaces are provided then as the liquid level 51 changes with time or becomes lower with time, then different lips, step portions or annular surfaces may become exposed. Exposed surfaces may no longer be used since the laser radiation should ideally be focused below the upper level of the liquid. However, as the liquid level 51 changes with time, different lips, step portions or annular surfaces may be located at the optimum depth below the upper surface 51 of the liquid level. Therefore, according to various embodiments an outermost lip, step portion or annular surface may initially be utilised and as the liquid level drops with time the laser radiation may be directed onto to inner lips, step portions or annular surfaces.

The provision of multiple lips, step portions or annular surfaces which may be provided at different depths relative to the upper liquid level 51 enables bubble formation to occur at a metalised surface 52 which is as close as possible to an optimum depth below the surface 51 of the liquid.

Various embodiments are contemplated wherein the vertical spacing of the lips, step portions or annular surfaces is set so that a laser can always be focused on to a lip, step portion or annular surface which is a desired depth below the upper surface 51 of the liquid in a manner which is independent of the exact liquid level in the well.

The metallic or metal film 52 may be overcoated with a thin layer of a polymeric material in order to prevent any toxicity effects of the metallic or metal film 52 for long term incubation.

Although the present invention has been described with reference to preferred embodiments, it will be understood by those skilled in the art that various changes in form and detail may be made without departing from the scope of the invention as set forth in the accompanying claims.

The invention claimed is:

1. A method of mass spectrometry comprising:

focusing electromagnetic radiation into a region of a liquid sample below a surface of the liquid sample so as to generate one or more bubbles which rise to the surface of the liquid whereupon one or more droplets of liquid are emitted from the surface of the liquid sample; and directing the one or more emitted droplets towards an inlet of a mass spectrometer or an ion source.

2. A method as claimed in claim 1, wherein the liquid sample is provided in a sample well of a microtitre plate or multi-well sample plate.

3. A method as claimed in claim 2, wherein the step of focusing electromagnetic radiation comprises directing electromagnetic radiation either: (i) through a base or lower portion of the microtitre plate or multi-well sample plate; (ii)

through a sidewall or side portion of the microtitre plate or multi-well sample plate; or (iii) from above an upper surface of the liquid.

4. A method as claimed in claim 1, wherein the step of focusing electromagnetic radiation comprises directing the electromagnetic radiation through one or more focusing lenses; and wherein the method further comprises moving or translating the one or more focusing lenses in order to focus or auto-focus the electromagnetic radiation to a desired depth below an upper surface of the liquid sample.

5. A method as claimed in claim 4, wherein the step of focusing electromagnetic radiation comprises directing the electromagnetic radiation through one or more focusing lenses; and wherein the method further comprises passing a second source of electromagnetic of laser radiation through the one or more focusing lenses in order to determine the location of the upper surface of the liquid sample.

6. A method as claimed in claim 1, further comprising reflecting the electromagnetic radiation using a mirror having one or more apertures.

7. A method as claimed in claim 6, further comprising causing or allowing the one or more emitted droplets to pass through the one or more apertures.

8. A method as claimed in claim 1, wherein the electromagnetic radiation has a wavelength in the wavelength range 750-1500 nm.

9. A method as claimed in claim 1, wherein the step of directing the one or more emitted droplets towards an inlet of a mass spectrometer comprises causing the one or more emitted droplets to pass through an electric field defined by two or more electrodes, wherein the electric field is arranged to cause the one or more emitted droplets to elongate and emit oppositely charged jets towards the electrodes.

10. A method as claimed in claim 9, further comprising directing at least one jet through at least one aperture in at least one of the electrodes towards an inlet of the mass spectrometer.

11. A method as claimed in claim 1, wherein the step of directing the one or more emitted droplets towards an inlet of a mass spectrometer comprises directing the one or more emitted droplets into an open port probe sampling interface.

12. A method as claimed in claim 11, further comprising capturing the one or more emitted droplets and diluting the one or more emitted droplets into a continuous flow of solvent.

13. A method as claimed in claim 12, further comprising aspirating the flow into an electrospray ionisation ion source.

14. A method as claimed in claim 1, further comprising increasing or varying the intensity or pulse energy of electromagnetic radiation focused into the region of the liquid sample until one or more bubbles are observed or detected and/or analyte ions are detected.

* * * * *